United States Patent [19]

Bassett et al.

[11] Patent Number: 4,967,737

[45] Date of Patent: Nov. 6, 1990

[54] METHOD AND DEVICE FOR TREATING BONE DISORDERS CHARACTERIZED BY LOW BONE MASS

[75] Inventors: C. Andrew L. Bassett, Bronxville, N.Y.; Govert L. Bassett, Charlotte, N.C.

[73] Assignee: Osteg Dyne Inc., Charlotte, N.C.

[21] Appl. No.: 227,994

[22] Filed: Aug. 3, 1988

[51] Int. Cl.[5] ..... A61H 1/02

[52] U.S. Cl. ..... 128/25 B; 128/25 R; 128/24.2; 128/24.1; 128/33; 272/96; 272/146; 272/DIG. 6

[58] Field of Search ..... 128/24 R, 24.1, 25 B, 128/25 R, 33; 272/146, 96, DIG. 6

[56] References Cited

U.S. PATENT DOCUMENTS

| | | | |
|---|---|---|---|
| 1,948,534 | 2/1934 | Nelson et al. | 128/25 B |
| 3,426,369 | 2/1969 | Cauthron | 128/33 |
| 3,492,988 | 2/1970 | De Mare | 128/25 B X |
| 3,548,811 | 12/1970 | Wilson | 128/25 B |
| 3,550,585 | 12/1970 | Howard | 128/24 R |
| 3,774,597 | 11/1973 | Root | 128/25 B |
| 4,151,839 | 5/1979 | Schwarz | 128/25 R X |
| 4,185,622 | 1/1980 | Swenson | 128/25 B |
| 4,270,749 | 6/1981 | Hebern | 272/146 X |
| 4,628,909 | 12/1986 | Tietsworth | 128/25 R |
| 4,676,501 | 6/1987 | Hoagland et al. | 128/25 B X |
| 4,705,028 | 11/1987 | Welby | 128/25 B |
| 4,774,959 | 10/1988 | Palmer et al. | 73/599 X |

FOREIGN PATENT DOCUMENTS

| | | | |
|---|---|---|---|
| 0912602 | 10/1972 | Canada | 272/96 |
| 1292358 | 3/1962 | France | 128/25 B |

OTHER PUBLICATIONS

Rubin et al., "Prevention of Osteoporosis by Pulsed Electro—Magnetic Fields: An in vivo Animal Model Identifying an Osteogenic Power Window", (Jul. 15, 1988, Pre—Print; Journal of Joint Surgery, 71—(A): 411—417, Apr., 1989).

*Primary Examiner*—Richard J. Apley
*Assistant Examiner*—Joe H. Cheng

[57] ABSTRACT

A method and device are described for providing passive exercise treatment for increasing the amount, strength and proper anatomical distribution of bone in a patient suffering from a bone disorder. The method involves determining a value for impact load, impact rate, and treatment duration for the patient to provide treatment for the bone disorder, and repeatedly lifting the patient's heels a prescribed drop excursion and then allowing the patient's heels to drop from the prescribed drop excursion to impart the determined impact load at the determined impact rate for the determined treatment duration. The values for impact load, impact rate, and treatment duration are signals based upon the characteristics of the patient's skeletal tissue and ensure that an electrical signal generated in that tissue has certain characteristics. This method may be effected by a device with a pivoting platform, a pivoting lift lever linked to the pivoting platform, a cam follower located at a free end of the lift lever, a cam engaging the cam follower, and a motor rotatably coupled to the cam.

27 Claims, 4 Drawing Sheets

METHOD AND DEVICE FOR TREATING BONE DISORDERS CHARACTERIZED BY LOW BONE MASS

BACKGROUND OF THE INVENTION

The present invention relates generally to the treatment of osteoporosis and afflictions characterized by inadequate local or general bone mass, and specifically the use of gravity-driven impact loading for such treatment.

Osteoporosis is a pernicious disorder usually, but not exclusively, afflicting elderly women. The osteoporotic state can also be manifest by those who are confined to bed and even by astronauts who are in a weightless environment. Osteoporosis occurs through a decrease in the density of bone mass which makes the afflicted bones more fragile and more susceptible to breaking.

Osteoporosis often is a debilitating problem. The injuries resulting from osteoporosis can require extended hospital stays, and sometimes involve expensive and painful surgery. Health care costs for this condition approach ten billion dollars per year in the U.S. alone. In addition, osteoporosis severely diminishes the mobility and vitality of those affected with the disease.

The general population also feels the effects of this disease. Persons afflicted with osteoporosis must depend upon relatives and others for care, and everyone is affected by the health costs and the use of hospital facilities attributable to this affliction.

The reduction in bone mass from osteoporosis results when bone destruction outpaces bone formation. The balance between destruction and formation is affected by horomones, calcium intake, vitamin D and its metabolites, weight, smoking, alcohol consumption, exercise and many other factors too numerous to mention.

To slow or reverse bone loss, doctors have focused their attention on estrogens, calcium, and exercise, used either together or individually. More recently, fluorides and thiazides have been tested as therapeutic agents, but none of these approaches has been successful in restoring a severely depleted skeleton to normal. In addition, many elderly individuals with advanced bone loss cannot participate in exercise programs due to poor reflexes, motor tone and balance, as well as stress pain and stress fractures.

It is therefore desirable to find unique methods for treating osteoporosis and its related conditions. A promising avenue is based on Wolff's law which, in short, states that bone adapts to the forces acting upon it. In other words, bone will remodel to relieve the applied stress.

Certain researchers have suggested an electrical intermediary in Wolff's law. Because bone is piezoelectric and electrokinetic, it generates an electrical signal in response to the applied force. That electrical signal then effects bone formation. This is explained in Bassett, "Effect of Force on Skeletal Tissues", Physiological Basis of Rehabilitation Medicine, Downey and Darling eds., 1st ed., W. B. Saunders Co., (1971); (1971); ("Bassett '71"). On the basis of Wolff's law and more recent investigations, two techniques have been developed for treatment of bone disorders. One involves mechanical forces and the other involves electrical forces.

One of the first and most complete investigations into the effect of mechanical loading on bone tissue was reported in Cochran et al., "Electromechanical Characteristics of Bone Under Physiologic Moisture Conditions", Clinical Orthopaedics 58: 249–270 (1968). In that article, both in vitro and in vivo measurements showed the electrical potentials developed due to bone deformation. The results of this and related work led to the use of electromagnetic stimulation to control bone tissue as reported in Bassett et al., "Augmentation of Bone Repair by Inductively Coupled Electromagnetic Fields", (Science, 184: 575–77, (1974), and Bassett et al., "A Non-Operative Salvage of Suurgically Resistant Pseudartrrhroses, and Non-Unions by Pulsing Electromagnetic Fields, A Preliminary Report", (Clinical Orthopaedics, (184: 128–143(1977). Such work and research also led to the development of products for the stimulation of bone tissue electromagnetically. In addition, some work was carried over into the treatment of osteoporosis, as reported in Bassett et al., "Prevention of Disuse Osteoporosis in the Rat by Means of Pulsing Electromagnetic Fields",(in Brighton et al., *Electrical Properties of Bone and Cartilage: Experimental Effects and Clinical Applications*, 311–331, 1979); Cruess et al., "The Effect of Pulsing Electromagnetic Fields on Bone Metabolism in Experimental Disuse Osteoporosis", (Clinical Orthopaedics, 173: 245–250, 1983); and Rubin et al., "Prevention of Osteoporosis by Pulsed Electromagnetic Fields: An in vivo animal model identifying an osteogenic power window", (Preprint, July, 1988);"

The Cochran paper also suggested the possibility of a critical mechanical loading rate to generate maximal voltages. To this end, patients have been treated with axial compression exercises, as reported in Bassett '71, on pages 312–314. In general, however, this work has received less attention than the electromagnetic work.

Some interest in mechanical methods of controlling bone loss has continued. For example, the National Aeronautic and Space Administration funded a study whose purpose was to use impact loading on patients' heels to stimulate bone formation. Reference to this work was described in an abstract printed in the U.S.P.H.S. Professional Association, 11th Annual Meeting (May 26–29, 1976), and entitled "Modification of Negative Calcium Balance and Bone Mineral Loss During Bed Rest: Impact Loading". The abstract reported that impact loading, which was kept to 25 pounds, could slow down the loss of calcium and achieve other beneficial results.

More recently, two papers by Rubin and Lanyon have suggested that periodical strain rates and cycling patterns generate maximal osteogenic response in avian bones. In one of those papers, entitled "Regulation of Bone Formation by Applied Dynamic loads", (The Journal of Bone and Joine Surgery, 66-A(3): 397–402 (March 1984), an experiment demonstrated that cyclically loading the bones at 0.5 Hz caused bone formation, although repetition of more than 36 cycles did not seem to increase bone formation. The paper also suggested that an abnormal strain distribution caused an increase in bone mass. In a later paper by Ruben et al entitled "Regulation of Bone Mass by Mechanical Strain Magnitude," (Calcip Tissue, Int. 37: 411–417, 1985), Rubin and Lanyon also showed a graded dose response subjected to 100 load cycles at 1 Hz showed a graded dose response relationship between peak strain and change in bone tissue mass.

No one, however, had yet been able to translate this general laboratory information into a clinically effective device or method for treatment of osteoporosis conditions.

Therefore, it is an object of the present invention to devise a treatment for osteoporosis in humans which is both safe and effective.

It is a further object of the present invention to employ the concept of a critical loading factor in the treatment device for osteoporosis and other skeletal problems in which a diminished bone mass is present.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a method for providing passive exercise treatment for increasing the amount, strength, and proper anatomical distribution of skeletal tissue in a patient suffering from a bone disorder. The method comprises the step of determining a value for impact load, impact rate, and treatment duration for the patient to provide treatment for the bone disorder. The value is based upon characteristics of the patient's skeletal tissue and is chosen to ensure that the impact load and rate generate electrical signals in the patient's skeletal tissue such that the majority of energy at such signals lies between 0.1 Hz and 1 kHz, and the peak amplitude values for such signals lies between 15 and 16 Hz. The method further comprises the steps of lifting the patient's heels a prescribed drop excursion using a mechanical device, the prescribed drop excursion being determined according to the determined impact load value, and then allowing the patient's heels to be dropped from the prescribed drop excursion to impart the determined impact load value on the patient's skeletal tissue. The method of this invention also comprises the step of repeating, at the determined impact rate for the determined treatment duration, the steps of lifting the patient's heels and allowing the patient's heels to drop.

Also in accordance with the present invention, a device for use in treating a patient suffering from a bone disorder comprises a pivoting platform having one end, which is designed to support the patient's heels, capable of being elevated.

The device further comprises cylic lifting means for this end of the platform so it may be alternatively lifted and dropped. The cylic lifting means may include a pivoted lever linked to the lifted end of the platform. The pivoted lever may have a cam follower at its non-pivoted end, and a cam engaging the cam follower. The cam could include means for gradually lifting the one end of the platform in a controlled manner to raise the patient's heels a prescribed drop excursion, and means for allowing the one end of the platform to drop the prescribed drop excursion to impart a desired load to the skeletal tissue of the patient, where the prescribed drop excursion is determined in accordance with a desired impact load to be imparted to the patient.

The device further comprises a motor rotatably coupled to the cyclic lifting means or cam for causing the cyclic lifting means or cam to rotate and for alternately lifting the one end of the platform and allowing the one end of the platform to drop the prescribed distance. A control is provided to vary the speed of motor and thus the rotation of the cyclic lifting means or cam. This in turn causes the desired load to be imparted to the patient at the desired rate and causes the patient's skeletal tissue to generate an electrical signal having a majority of its energy between 0.1 Hz and 1 kHz, with the peak amplitude values lying between 15 and 16 Hz.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Figure 1:
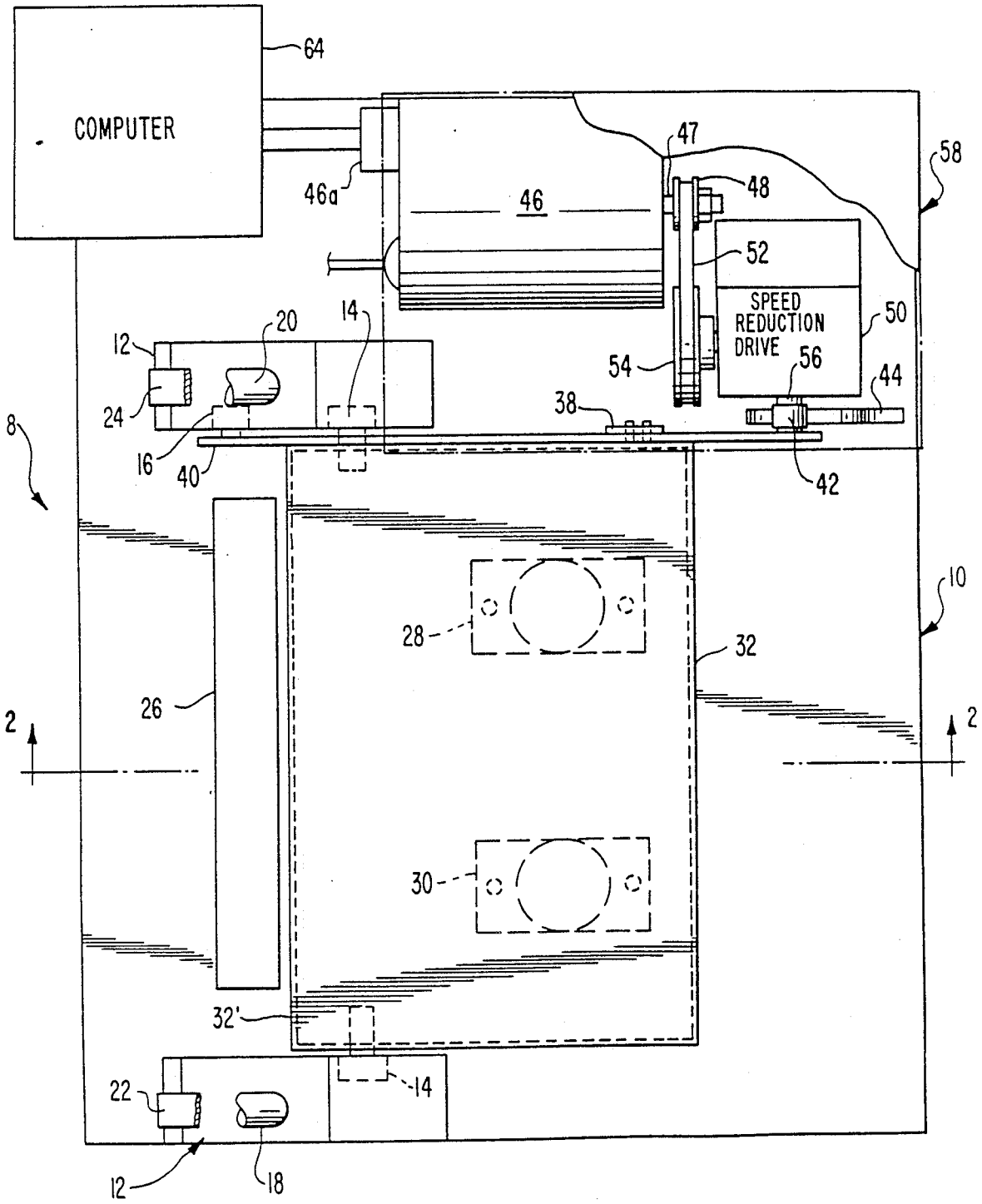
FIG. 1 is an elevational view of a device for treating a patient suffering from bone disorders incorporating the teachings of the present invention.

Reference will now be made in detail to the presently preferred embodiment of the invention as illustrated in the accompanying drawings.

In accordance with the present invention there is provided a method for providing passive exercise treatment for increasing the amount, strength and proper anatomical distribution of bone in a patient suffering from a bone disorder. The method can employ a wide range of structures. Two embodiments of the structures are shown in FIGS. 1–6.

The first step in the method is to determine values, based upon characteristics of a patient's skeletal tissue, for impact load, impact rate, and treatment duration. The patient's skeletal tissue characteristics include the amount of bone, as well as the bone's strength and anatomical distribution. The impact load and the impact rate are chosen to generate electrical signals in the patient's skeletal tissue such that the majority of energy of the electrical signals lies between 0.1 Hz and 1 kHz with the peak amplitude values lying between 15 and 16 Hz.

The value for impact load and impact rate for the treatment to be prescribed for a particular patient can be made several ways. The ultimate desire is to find values for these parameters which, when combined with the impact load and rate which the patient is generating naturally by his or her own behavior, will promote normal bone formation and structure.

Preferably, such determination is made by first measuring the impact load and rates generated by a patient when walking normally, and then comparing that measured impact load and rate to values for "typical" impact loads and rates. Such typical values may be retrieved from data reflecting ranges of impact loads and rates which members of the general population have been found to have delivered to their skeletons during normal walking activity. The impact load and impact rate to be prescribed for a particular patient would be those values necessary to augment the patient's own measured impact load and rate values such that the total values are in the typical ranges for the general population.

Preferably, the tables of ranges of typical ranges for impact loads and rates would be developed from published data, such as the references described in the background of invention as well as other references, such as L. E. Lanyon et al., "Strain Related Electrical Potentials Recorded In Vitro and Vivo", (Calcif. Tiss: Res. 2, 315–327 1977); ("Lanyon '66'"), and would be updated by current measurements based on subjects taken from a cross-section of the population. Preferably, the table would be subdivided into several salient categories, such as age, weight, skeletal structure, sex, and prior medical history. The categories should be those which an orthopedic surgeon or physician should take into account when prescribing treatment for osteoporotic symptoms.

To complete the data base, the patients' and subjects' height, weight, sex, and medical history should be taken, and information regarding the patients' and subjects' skeletal structure should be measured. Such information, which includes determinations regarding the amount of bone, its strength, and its anatomical distribution, may be obtained using several conventional methods. A common method uses a dual photon absorptiometry, such as can be provided using a Lunar DP3 scanner.

When prescribing a treatment regimen, care must be taken to ensure that the treatment is focused within a particular range which has been found to be the most efficacious. The best response for improving bone condition has been found for impact loads and rates which generate electrical responses in skeletal tissue such that the majority of energy lies in the range of 0.1 Hz to 1 kHz, and the peak amplitude values for such signals lie between 15 and 16 Hz (see Lanyon '66). The electrical response in bone for a particular impact rate and load can be determined based from available data correlating those parameters, such as the reference described above. It has been found that in the range of 0.1 Hz to 1 kHz, the electrical responses are linearly related to the impact load when the threshold strain rates are reached.

To determine the frequencies for the peak values for the electrical response for a given impact load and impact rate, any type of spectrum analysis, such as a Fourier analysis, can be used. With such analysis, one can easily obtain the frequencies in which the majority of energy and peak values lie. From such a determination, one can then adjust the prescribed impact load and rate to fall within the desired range. Initially, it is desirable to start the patient out with a low load rate and a low drop. Then after about one month, the damping factor may be decreased and the excursion factor increased.

Preferably, the duration of treatment would be determined in accordance with experimental data. It has been found that repetitions of more than 30–40 cycles per day of impact load produce no additional benefit. Thus, the treatment duration would preferably be determined by such experimental data.

The method further comprises the steps of lifting the patient's heels a prescribed drop excursion and then allowing the patient's heels to drop from the prescribed drop excursion under the force of gravity. The steps of lifting and allowing the patient's heels to drop are then repeated at the determined impact rate for the determined treatment duration.

A device according to the present invention for use in treating a patient suffering from bone disorders will now be described in detail with reference to FIGS. 1–4. The device is shown generally at 8. A base 10 for the device rests on the floor or ground. Base 10 supports bearing blocks 12. Bearings 14 located in bearing blocks 12 allow free rotation of the platform 32. The pivot point is located so as to provide greater linear movement of one end of platform 32. This end is designed to support the patient's heels and is called the "lifted end." A toe support 26 supports the toes of the patient as platform 32 pivots. As shown in FIG. 1, the right bearing block 12 also has a pivot bearing 16 about which the fixed end of a lift lever 40 pivots. Lift lever is connected to platform 32 by a link 38. As the free end of lift lever 40 is raised, the lifted end of platform 32 is also raised.

Figure 2:
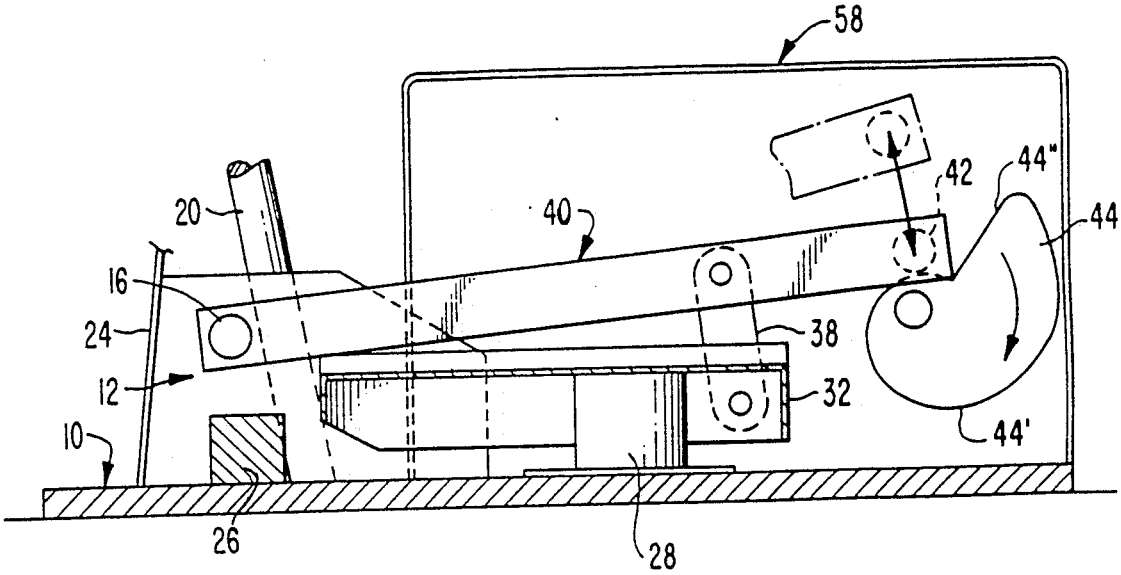
FIG. 2 is a side view of components of the device illustrated in FIG. 1 and taken across lines 2—2 in FIG. 1.
Figure 3:
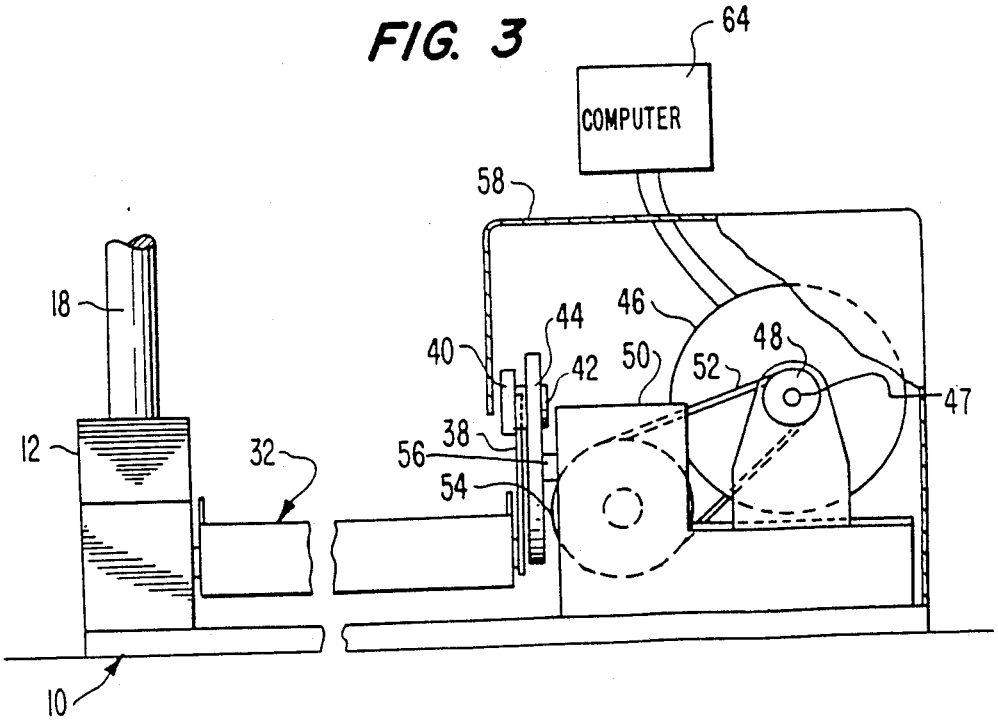
FIG. 3 is a side view of other components of the device illustrated in FIG. 1.
Figure 4:
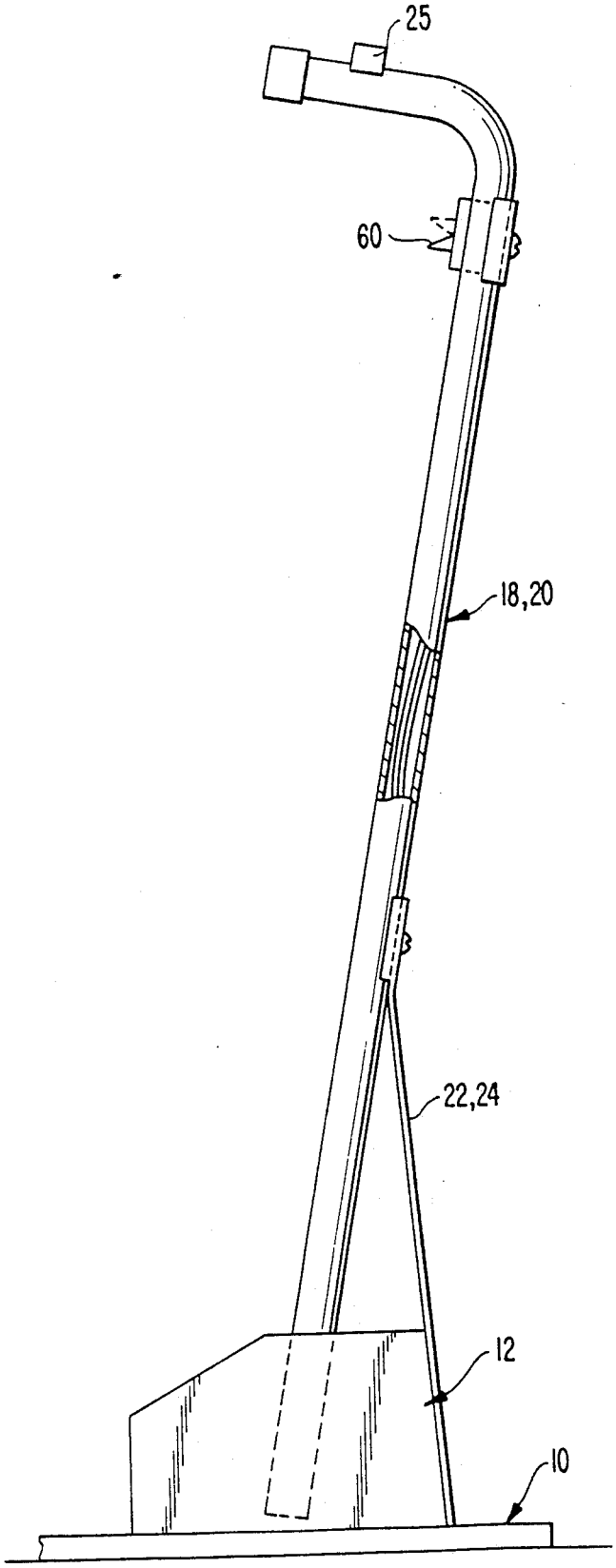
FIG. 4 is a side view of the handlebars and the base.

In accordance with the present invention, the device for treating patients includes cyclic lifting means for alternately lifting and lowering the free end of the lift lever to cause the platform to lift the patient's heels and allow them to be dropped the prescribed drop excursion. As shown in FIGS. 2–4, such means may include a roller cam follower 42 and cam 44. Roller cam follower 42 is placed on the movable end of lift lever 40 and rests on lift cam 44 which rotates in the direction shown in FIG. 2. As cam 44 rotates, cam follower 42 rides on the cam surface and raises lift lever 40. Alternatively, a piston may be substituted for the cam.

As another alternative, platform 32 may be moved by reverse activation. Instead of physically lifting one end of the platform, fixed end 32' could be depressed by a cam to raise the lifted end of platform 32. Fixed end 32' could also be depressed by a linear actuator having a fixed or variable speed and capable of variable height-/length of activation or depression.

Still another alternative emboidment of this invention involves a movable pivot. In such an embodiment, a round bar would be placed under the platform and is moved (e.g., from right to left in FIG. 1) with the patient standing On platform 32. As the bar reaches the location of the pivots or bearings 14, the platform will tilt so as to cause a free fall to the stops on the right side of the platform, and thus accomplish the same effect as the cam or linear actuator.

In this technique, the cycle would consist of initially placing the bar to the extreme right under platform 32 as shown in FIG. 1 and then moving the bar to the left until it reaches the position of the pivots 14. At that point, the bar stops and is drawn back to the right until it is again at or close to the extreme right hand end of the platform. The diameter of the bar is adjusted to provide the desired free fall of the lifted end of the platform 32, or alternately, the depressed end is lowered to proper position to allow a proper fall of the other end.

Also in accordance with the present invention, the cam includes means for gradually lifting the free end of the lift lever and means for allowing the platform to drop the prescribed drop excursion. In the preferred embodiment, cam 44 includes a gradually increasing curved surface 44' which gradually lifts the free end of the lift lever 40 which is connected to platform 32 in a controlled manner to raise the patient the prescribed drop excursion. Lift cam 44 further includes a sharp discontinuous surface 44'' which allows the free end of the lift lever 40 which is connected to platform 32 by lift link 38 to drop the prescribed drop excursion to impart a desired load to the patient. The prescribed drop excursion can be adjusted by modifying the surface of lift cam 44. Additionally, the prescribed drop excursion may be adjusted by varying the length of lift link 38.

Using the preferred structure, the patient's heels are lifted the prescribed distance and allowed to drop by placing the patient on pivoting platform 32. Lift cam 44 is rotated so that cam follower 42 rides on the cam surface and raises lift lever 40, and thus pivoting platform 32. Alternatively, fluid powered or electrically powered linear actuators may be used to accomplish the lifting of platform 32.

As shown in FIGS. 1–4, lift cam 44 is periodically rotated by drink means, such as an electric motor 46. Motor 46, shown in FIG. 1 as housed in a drive cover 58, is activated by a toggle switch 60. Lift cam 44 is attached to an output shaft 56 of a speed reduction drive 50. A reduction drive input shaft carries a pulley 54 which is driven by a timing belt 52 and a motor pulley 48 mounted on a motor output shaft 47. Pulleys 48, 54 are selected to drive speed reduction drive 50 and can be adjusted to control the rotation speed. The motor for driving the cam may be pneumatic, hydraulic or internal combustion. In the present invention, the drink means includes rate adjustment means for controlling the speed of the motor. Preferably motor 46 has a rate controller **46*a* coupled to motor 46 to control the rate of motor 46. The rate of rotation could also be controlled using speed reduction drive 50**.

In accordance with the present invention, means are provided to adjust the prescribed drop excursion for adjusting the damping of the platform. Stops 28, 30 mounted on base 10 can provide both of these functions. In its horizontal position, pivoting platform 32 rests on stops 28, 30. Stops 28, 30 prevent the platform from dropping further than the prescribed drop excursion and damp the impact produced when platform 32 drops. Stops 28, 30 may be formed of a rigid, plastic or viscoelastic material to provide various levels of damping, depending on their material properties. Additionally, stops 28, 30 may be formed of different heights in order to adjust the prescribed drop excursion the patient is lifted.

In accordance with the present invention, computer means, such as computer 64, may be provided to control various parameters of the device. Preferably computer 64 includes a microprocessor. Computer 64 may be programmed to control the prescribed drop excursion which the patient is lifted by selecting different stops. Computer 64 may also be programmed to provide variable damping of the platform in the same manner. Furthermore, computer 64 may be used to control the rate of repetition of the lifting and dropping steps by controlling the speed of motor 46.

Computer 64 may also be programmed to perform the necessary calculations for impact load, impact rate and treatment duration. In the preferred embodiment of the apparatus of this invention, computer 64 would contain the data base for the typical values related to the patient population and characteristics indicated above. If computer 64 is used in this manner, the patient data and dual photon absorptiometry measurements are entered into computer 64 which then determines the impact load and rate for the desired treatment reqimen. As described above, computer 64 can then be used to set the components of device 8 to obtain that regimen.

As shown in FIGS. 2–4, block 10 also provides support for handlebars 18, 20. Handlebars 18, 20 are reinforced by brackets 22, 24 and allow the patient a mechanism for maintaining his or her balance during treatment. An indicator 25 which is controlled by computer 64 is provided on handlebars 18, 20 for signaling the patient when it is time for the next treatment. Indicator 25 may be, for example, a light, bell, buzzer or whistle. In addition, a switch may be provided on one of the handlebars 18, 20 which causes platform 32 to return to the horizontal position to allow the patient to get on and off.

Figure 5:
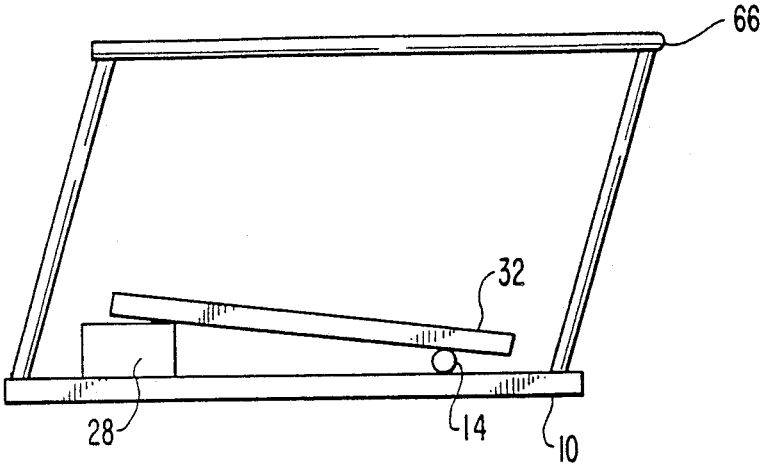
FIG. 5 is a side view of a second embodiment of the present invention.
Figure 6:
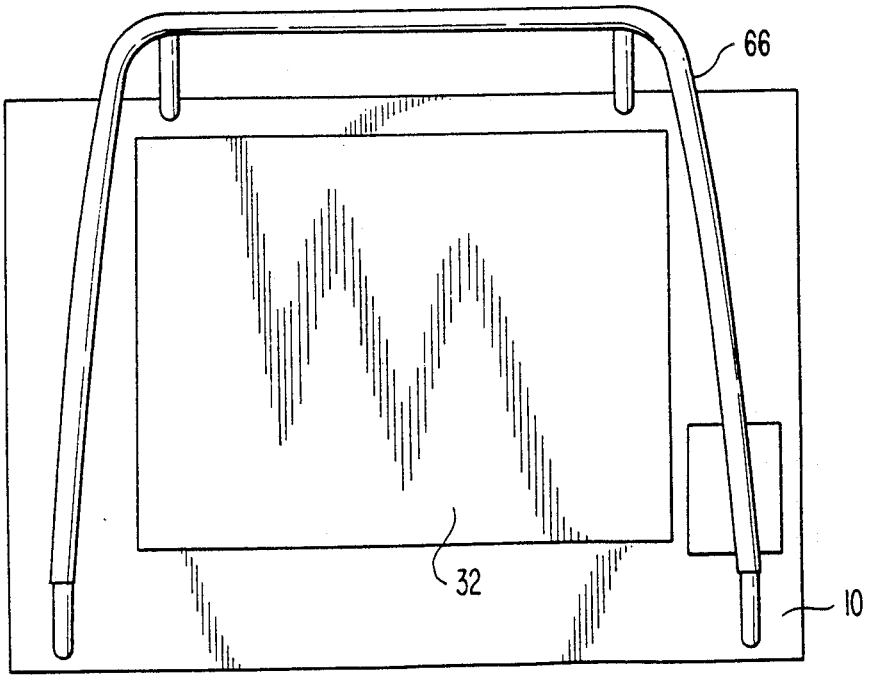
FIG. 6 is an elevational view of the embodiment shown in FIG. 5.

According to a further embodiment of the invention as shown in FIGS. 5 and 6, the base 10 may include a U-shaped frame or cage 66. Cage 66 rests on base 10 and contains the patient. The cage thus supports the patient and maintains the patient's balance during treatment. Indicator 25 and the switch described above may be incorporated in the U-shaped frame.

In operation, the patient stands on the platform, using the handle bars for balance if necessary. Motor 46 causes cam 44 to rotate and alternately lift platform 32 the prescribed drop excursion and to allow platform 32 to drop the prescribed drop excursion. As cam 44 rotates, its shape is such that after it has raised cam follower 42 to maximum height, it no longer supports cam follower 42 and platform 32. The shape of am 44 thereby permits a free-fall of the platform 32 under the force of gravity onto stops 28, 30 and causes the individual and platform 32 to come to rest.

The present invention is directed to a mechanical means of producing endogenous electrical sources. An advantage of the present invention is that it is compatible and complementary with exogenous sources such as electrodes or time-bearing electric fields.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A method for providing passive exercise treatment for increasing the amount, strength and proper anatomical distribution of skeletal tissue in a patient suffering from a bone disorder, the method comprising the steps of:

determining a value, based upon characteristics of the patient's skeletal tissue, for impact load, impact rate, and treatment duration for the patient to provide treatment for said bone disorder, said impact load and said impact rate being chosen to generate signals in the patient's skeletal tissue such that the majority of energy of said electrical signals lies between 0.1 Hz and 1 KHz, with the peak amplitude values lying between 15 and 16 Hz;

lifting the patient's heels to perform a prescribed drop excursion by using a mechanical device, said prescribed drop excursion being determined according to said determined impact load value;

allowing the patient's heels to gravitationally drop said prescribed drop excursion to impact said determined impact load value on the patient's skeletal tissue; and repeating, at said determined impact rate for said determined treatment duration, the steps of lifting the patient's heels and allowing the patient's heels to drop.

2. The method of claim 1 wherein the step of determining the value for impact load, impact rate and treatment duration includes the substep of determining the amount of bone in the patient's skeletal tissue.

3. The method of claim 1 wherein the step of determining the value for impact load, impact rate and treatment duration includes the substep of determining the strength of the bone in the patient's skeletal tissue.

4. The method of claim 1 wherein the step of determining the value for impact load, impact rate and treatment duration includes the substep of determining the anatomical distribution of bone in the patient's skeletal tissue.

5. The method of claim 1 wherein said step of lifting said patient's heels includes substeps of:

placing the patient onto one end of a platform of said mechanical device, and raising the one end of said platform to perform said prescribed drop excursion.

6. The method of claim 5 wherein the step of raising the one end of said platform includes the steps of:

engaging a cam follower at one end of a lift lever connected to said platform with a rotatable cam, and rotating said cam periodically with a drive means to cause said cam follower to raise said one end of said lift lever and thus to raise said platform.

7. The method of claim 6 wherein the step of rotating the cam with the drive means includes the step of driving said cam with a variable speed hydraulic motor.

8. The method of claim 7 wherein the step of rotating the cam with the drive means includes the step of driving the cam with a variable speed pneumatic motor.

9. The method of claim 6 further including the step of adjusting said prescribed drop excursion by placing controlling stops of differing heights under the platform, said stops engaging the platform as said patient's heels land after performing said prescribed drop excursion.

10. The method of claim 1 including the step of programming a computer to set said prescribed drop excursion automatically.

11. The method of claim 1 including the step of programming a computer to set the rate of repeating the steps of lifting and dropping automatically.

12. The method of claim 1 including the step of damping the drop of the patient's heels.

13. The method of claim 12 wherein said damping step includes the step of placing controlling stops of differing materials under a platform bearing the patient, said stops engaging said platform as said patient's heels are allowed to drop the prescribed drop excursion.

14. A device for use in treating a patient suffering from bone disorders, said device comprising:

(a) a pivoting platform having a lifted end designed to support the patient's heels and a fixed end opposite the lifted end;

(b) cyclic lifting means for alternately lifting and lowering said lifted end of said platform to lift the patient's heels and allowing the patient's heels to gravitationally drop a prescribed drop excursion to impart a desired load to the skeletal tissue of the patient, said prescribed drop excursion being determined in accordance with a desired impact load to be imparted to the patient; and (c) drive means rotatably coupled to said cyclic lifting means for causing said cyclic lifting means to rotate and alternately lift and lower said lifted end of said platform, said drive means including:

(1) rate adjustment means for controlling the speed of said drive means, and thus the rate of said cyclic lifting means, to cause said desired load to be imparted to the patient at a desired rate such that said desired impact load at said desired rate causes the patient's skeletal tissue to generate an electrical signal having the majority of its energy between 0.1 Hz and 1 KHz, with the peak amplitude values lying between 15 and 16 Hz; and (2) switch means for activating said drive means.

15. The device of claim 14 wherein the cyclic lifting means includes (a) a pivoting lift lever having a fixed end remaining relatively stationary and a free end capable of substantially vertical movement, and (b) a lift link connecting said lift lever to said pivoting platform to ensure that the free end of the lift lever raises the lifted end of the platform a predetermined distance.

16. The device of claim 15 wherein said cyclic lifting means includes:

(a) a cam follower located at said free end of said lift lever; and (b) a cam coupled to said drive means and engaging said cam follower, said cam including:

(1) means for gradually lifting said lifted end of said platform in a controlled manner to raise the patient's heel to perform said prescribed drop excursion; and (2) means for allowing said lifted end of said platform to drop said prescribed drop excursion.

17. The device of claim 16 wherein said means for gradually lifting includes a curved surface on said cam having a gradually increasing radius, and wherein the means for allowing said patient's heels to drop includes a sharp, discontinuous surface on said cam adjacent said curved surface.

18. The device of claim 16 further comprising handlebars located proximate said fixed end of said platform.

19. The device of claim 16 wherein the drive means is a variable speed hydraulic motor.

20. The device of claim 16 wherein the drive means is a variable speed pneumatic motor.

21. The device of claim 16 further including means for adjusting said prescribed drop excursion.

22. The device of claim 21 wherein said prescribed drop excursion adjusting means includes a plurality of stops of differing heights for placement under said platform to adjust said prescribed drop excursion, said stops engaging said platform as said patient's heel and after performing the prescribed drop excursion.

23. The device of claim 14 further including means for damping the drop of said platform.

24. The device of claim 23 wherein said damping means includes stops of differing materials placed under the platform for providing variable damping.

25. The device of claim 14 further including computer means for controlling the rate adjustment means.

26. The device of claim 14 further including computer means for determining the value for impact load, impact rate and treatment duration based upon characteristics of the patient's skeletal tissue.

27. The device of claim 14 further including an indicator of the time for a succeeding treatment.

* * * * *